US005361947A

United States Patent [19]

Lifshey

[11] Patent Number: 5,361,947

[45] Date of Patent: Nov. 8, 1994

[54] SINGLE USE FLUID DISPENSING DEVICE

[75] Inventor: Arthur L. Lifshey, East Brunswick, N.J.

[73] Assignee: Merck & Co., Inc., Rahway, N.J.

[21] Appl. No.: 27,966

[22] Filed: Mar. 8, 1993

[51] Int. Cl.[5] ..... B65D 37/00

[52] U.S. Cl. ..... 222/212; 222/541; 206/532

[58] Field of Search ..... 222/212, 215, 541, 478, 222/485, 566, 330; 206/532, 530, 531, 277, 484

[56] References Cited

U.S. PATENT DOCUMENTS 3,353,721 11/1967 Love ..... 222/330 X
4,787,536 11/1988 Widerstrom ..... 222/212
4,931,400 6/1990 Jitsukawa ..... 222/330

FOREIGN PATENT DOCUMENTS 150751 1/1984 European Pat. Off. .
407320 7/1989 European Pat. Off. .
2225000 11/1988 United Kingdom .

*Primary Examiner*—Gregory L. Huson
*Attorney, Agent, or Firm*—Hesna J. Pfeiffer; Sylvia A. Ayler; Joseph F. DiPrima

[57] ABSTRACT

A flexible fluid dispensing bottle is provided which conveniently meters out its contents in several small controlled doses. The device is designed to specifically provide multiple extended outlets to facilitate access beneath the fur of an animal ("comb effect") and to better spread treatment. In addition, the device uses a combination of bottle geometry, and internal ribs and cores to control capacity as well as volume displaced during individual pump strokes of the squeeze bottle.

2 Claims, 4 Drawing Sheets

SINGLE USE FLUID DISPENSING DEVICE

BACKGROUND OF THE INVENTION

A significant problem with previous devices for dispensing liquid medications topically is that they are bulky, cumbersome, contain many parts, are not easily carried in a handbag or pocket, and are expensive to make. Additionally, the devices are generally designed for multiple applications or reuse which increases the potential for contamination and/or aging of the liquid medication through long term use.

Unlike the previous devices the instant invention is a single use dispensing device designed for easy handling during application, easy twist-off/no tool opening, low cost and good distribution of the drug onto the subject being medicated.

SUMMARY OF THE INVENTION

A single use fluid dispensing device is provided with a bottle of suitable plastic material whose walls are convexed and a dispensing lid which consists of one or more extended outlets (nozzles) with openings, through which liquid is uniformly distributed. The openings are sealed until immediatly before the device is to be used and result from the removal of break-off tabs, which act as a leakproof seal until the device is opened. The shape of the bottle as well as the presence of internal cores, one or more internal ribs, or indented dimples determines the amount of liquid that is dispensed per pump stroke (full squeeze) of the bottle. The extended nozzles provide a means to get beneath the fur of an animal to apply the liquid medication directly to the skin. The outlets can be flow restricted by well known means, such as limiting the size of the opening, to also limit pump stroke volume.

Thus it is an object of the present invention to provide a single use fluid dispensing device that conveniently meters out its contents in several small controlled doses. Another object of the instant invention is to describe how the pump stroke volume is limited. Still another object of the invention is to provide a single use fluid dispensing device having a convexed body, internal cores, ribs, or indented dimples. Still another object of the invention is to provide a single use fluid dispensing device having nozzles which are flow restricted. These and other objects of the present invention will be apparent from the following description.

BRIEF DESCRIPTION OF THE DRAWINGS

For a more complete understanding of the invention, reference should be made to the embodiments illustrated in greater detail in the accompanying drawings.

In the Drawings.

Figure 1:
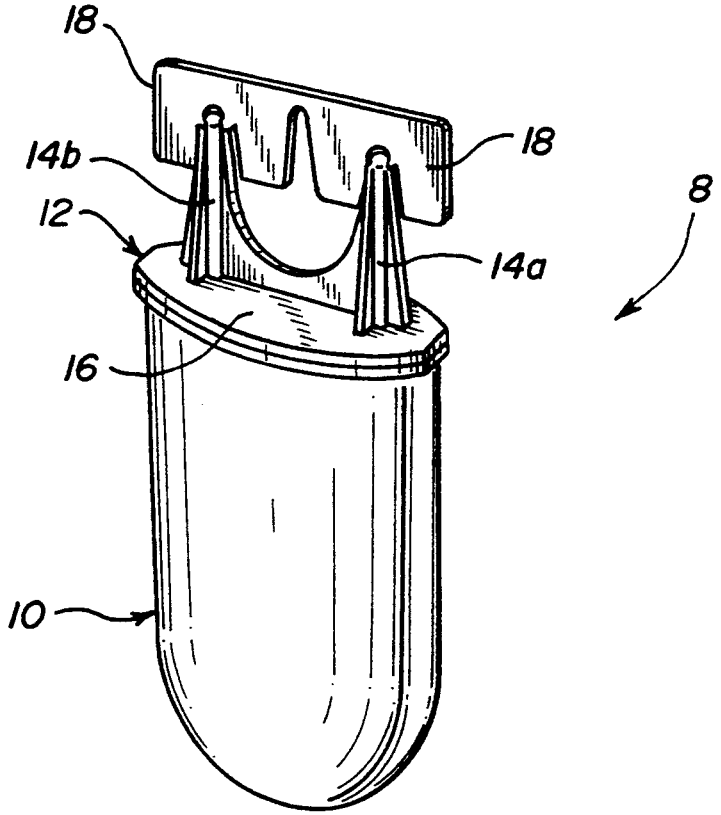
FIG. 1 is a perspective view of the dispensing device, wherein the walls of the bottle are convexed.
Figure 1A:
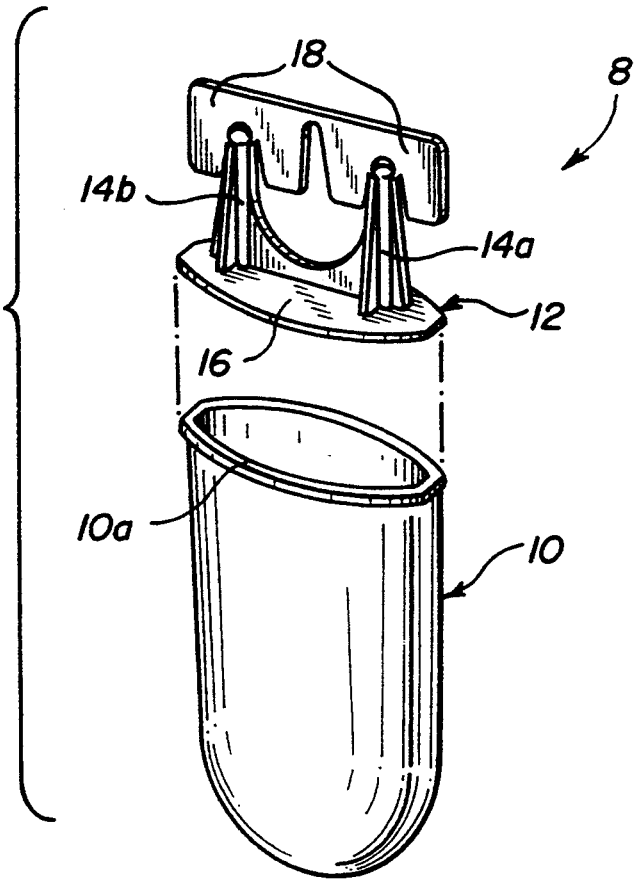
FIG. 1*a* is a perspective view of the dispensing device of FIG. 1, viewed before the dispensing lid is attached to the bottle.
Figure 2:
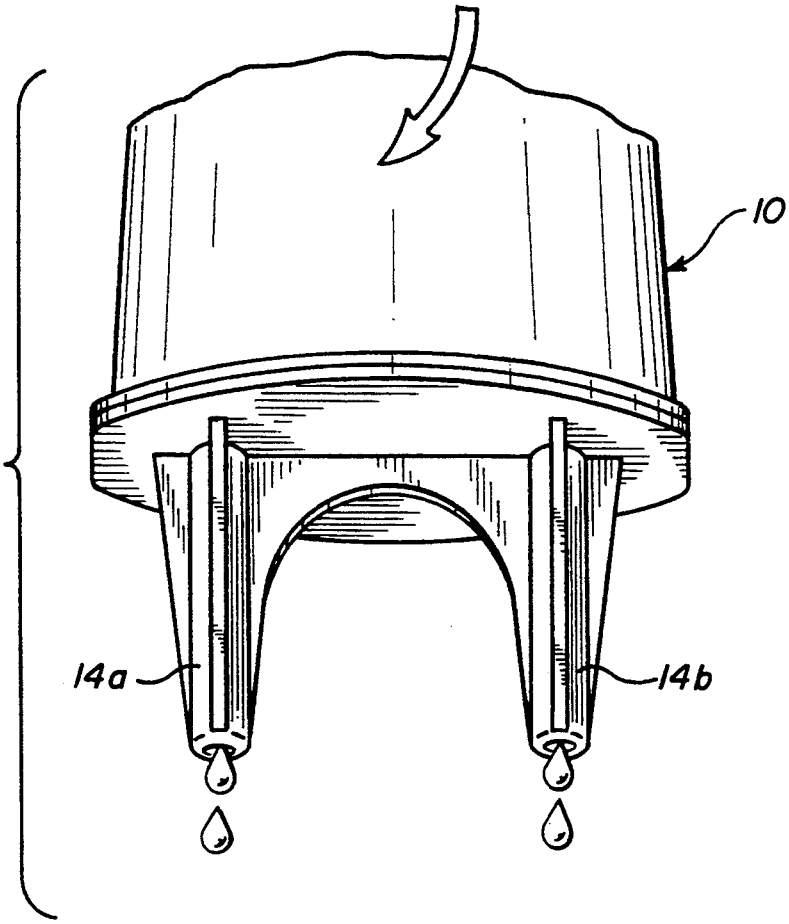
FIG. 2 is a perspective view of the dispensing device positioned for dispensing liquids without the break-away tab.
Figure 3:
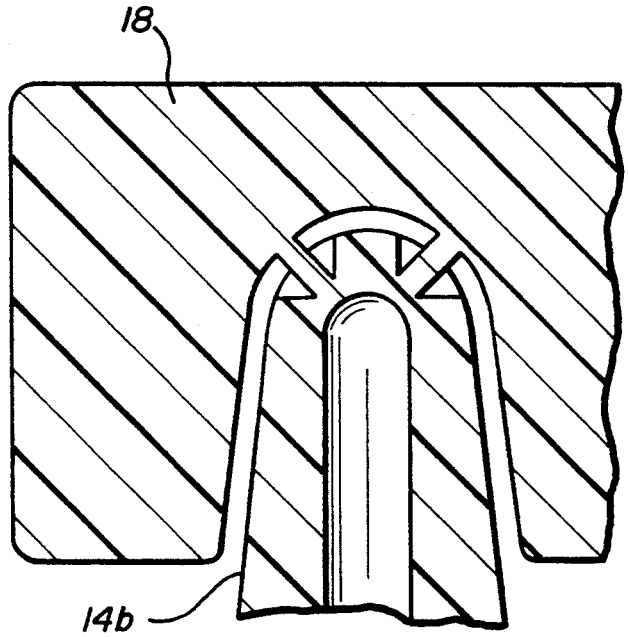
FIG. 3 is an enlarged cross-sectional view of a nozzle with the break-away security tab attached.

It should be understood that the drawings are not necessarily to scale and that the embodiments are sometimes illustrated by graphic symbols, phantom lines, diagrammic representations and fragmentary views. In certain instances, details which are not necessary for an understanding of the present invention or which render other details difficult to perceive may have been omitted. It should also be understood, of course, that the invention is not necessarily limited to the particular embodiments illustrated herein, and that optimum dimensional relationships include variations which are readily apparent and obvious to one skilled in the art and that all equivalent relationships to those illustrated in the drawings and described in the specification are intended to be encompassed by the present invention.

DETAILED DESCRIPTION OF THE INVENTION

This invention consists of a single use fluid dispensing device, which is intended for delivery of sterile fluids in 4 to 7 pump strokes for administration to any bodily surface, or intended for administration to the eye (ophthalmic fluids).

The dispensing device of the present invention has a sealed reservoir end for containing liquids and a dispensing end with one or more extended nozzles in a coplanar arrangement. Each of the nozzles has at least one opening for dispensing liquid and each opening is sealed by a removable sealing means. The reservoir end has paired inwardly deformable flexible side walls oppositely arranged which can be deformed by an inwardly applied force and reformed by releasing the force. The deformation is limited by pump stroke limiting means, whereby a full deformation of the side walls yields a fractional expulsion of the total liquid contents out of the nozzles and openings.

A key feature of this invention is its ability to conveniently meter out its contents in several small uniform doses (i.e., Multi-point Applicator-referring to the number of squeezes), which is achieved through a variety of mechanical displacement means, each of which may be used alone or in combination with each other. The pump stroke limiting means are based on the fact that liquid is expressed from extended outlets (nozzles) through the squeezing action on the flexible bottle which causes a volumetric displacement within the bottle.. The amount of liquid expressed from the nozzles is directly related to the volumetric displacement of the bottle. By limiting the amount of displacement per stroke the volume of liquid expressed per stroke is limited.

In the present invention, displacement is preferrably limited by one of three ways. The first way is to add internal ribs or cores (see FIGS. 4 and 5) to the interior of an injection molded flat or curved outer surface bottle. At a predetermined distance from the as-molded position of the bottle walls, the squeeze action encounters an obstruction caused by the contact with solid ribs on the opposing side or cores within the bottle. This obstruction limits further squeezing. The-user will then release the applied compressive load, which allows the bottle to return to its original shape, and prepares the applicator for its next stroke. The factors which affect the number of strokes/unit dosage are height, quantity and geometry of the ribs, orifice size in the nozzles, geometric shape of the bottle and the modulus of elasticity of the plastic resin.

Figure 6A:
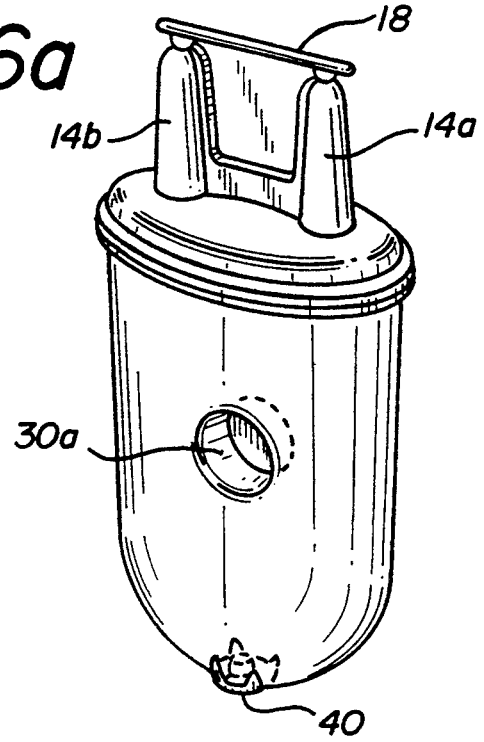
FIG. 6*a* and 6*b* is a perspective view of an alternative embodiment of the invention, wherein the bottle contains indentations or indented dimples.
Figure 6B:
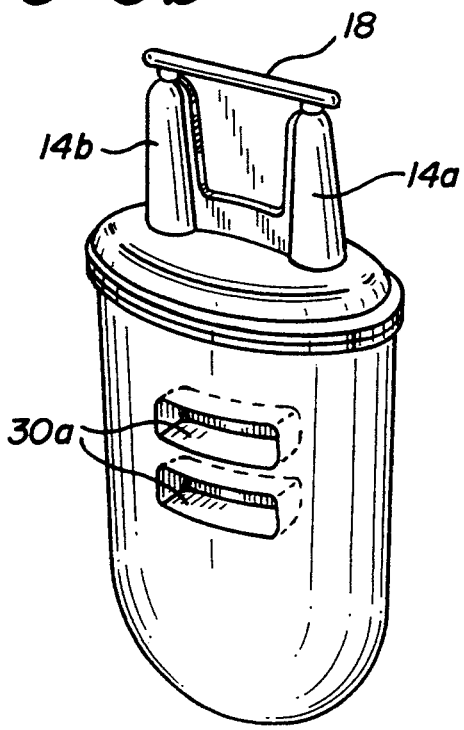

The second way for limiting stroke in the squeeze bottle of the present invention is through the use of molded-in dimples or indentations (See FIGS. 6*a* and 6*b*). In this embodiment, the indentation acts the same as the rib or core in limiting the mechanical stroke of the bottle.

The third and most preferred means of stroke limitation uses a combination of the geometric shape of the bottle, mechanical properties of the polymeric resin, and to a certain extent hydraulic back pressure to limit the pumping stroke (See FIG. 1). For illustration purposes only, the assumption will be made that the wall of the bottle acts as flat plates fixed on four edges. For small deflections of this plate caused by force applied to the center of the plate, the resistance to deflection is caused mostly by the bending stresses at the support. As the amount of deflection increases, membrane (tensile) stress become more significant, greatly increasing the force necessary to deflect the plate further. This increase in resistance due to the mechanical properties of the plastic is additive to the back pressure generated by the hydraulic resistance of the liquid being forced through the orifices in the nozzles.

Figure 7:
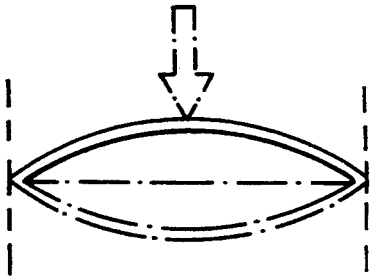
FIG. 7 is an illustration of the mechanism used to limit the pump stroke volume in FIG. 1, wherein the curved walls of the bottle goes from convex, to flat and then to concave.

In this preferred embodiment, the walls of the bottle are not flat, but curved with a specific radius so that the squeeze stroke begins with the walls convex, passing through flat, and then concave. See FIG. 7. By controlling the curvature in this manner, the amount of volume displaced before high forces set in can be controlled. In general, decreased radius (more convex) will increase stroke while increasing radius (more flat) will decrease stroke.

Another key feature of this invention is the presence of one or more nozzles, each extending sufficiently from the bottle to allow easy access to the skin below the animals fur, thereby providing a "comb effect" when making multi-point applications. To fulfill the function of getting underneath the hair of the animals the nozzle should be $\frac{1}{3}$ to 2 inches (0.5 to 5 cm) in length depending upon the length of the hair and spacing of the nozzles. The distance between the nozzles can range from $\frac{1}{4}$ of an inch to 3 inches (0.5 to 8 cm), preferably 0.5 to 1 inches (1 to 3 cm). The size of the openings in the nozzles is another means of limiting the volume displaced when using the device.

The fluid dispensing device 8 of the present invention varies in size and geometric shape and can be formed from a variety of materials such as, for example, soft or hard plastic, e.g., polypropylene, low density polyethylene, high density polyethylene, or other manually deformable material. The dispensing device 8 can be produced in one or two pieces by conventional blow molding, injection molding, thermoforming, or various form fill seal technologies. It is to be understood that the device of the present invention is not limited to its manufacture by any specific process as it will be understood by those skilled in the art that many different manufacturing techniques can be employed.

The preferred embodiment of the present invention consists of Bottle 10 made of a suitable plastic material, has walls that are convexed to create limited pumping action and stiffness, (stiffness refers to the ability of the device to resist deflection under load) and is adapted to contain a liquid medication, preferrably a physiologically acceptable, topical liquid antiparasitic medication. The neck of bottle 10 has a flange 10*a* which is complimentary in shape to the bottom of dispenser lid 12. Dispenser lid 12 consists of a base 16 and nozzles 14*a* and 14*b* which are positioned on the topside of base 12*a*. The nozzles are generally parallel and each contains one or more orifices, preferrably one, through which liquid is dispensed. The openings range from 0.010–0.040 inches in diameter (0.2 to 1.0 mm), preferrably 0.025–0.035 inches in diameter (0.6 to 0.9 mm) and are created when break-off security tab 18 is manually twisted or broken off. The openings are the result of controlled rupturing of the plastic material. Bottle 10 is attached to dispenser lid 12 by thermally sealing flange 10*a* and the bottom portion of base 16 together. Alternatively, dispensing device 8 can be produced as a single unit so that the dispenser lid is integral with bottle 10.

Figure 4:
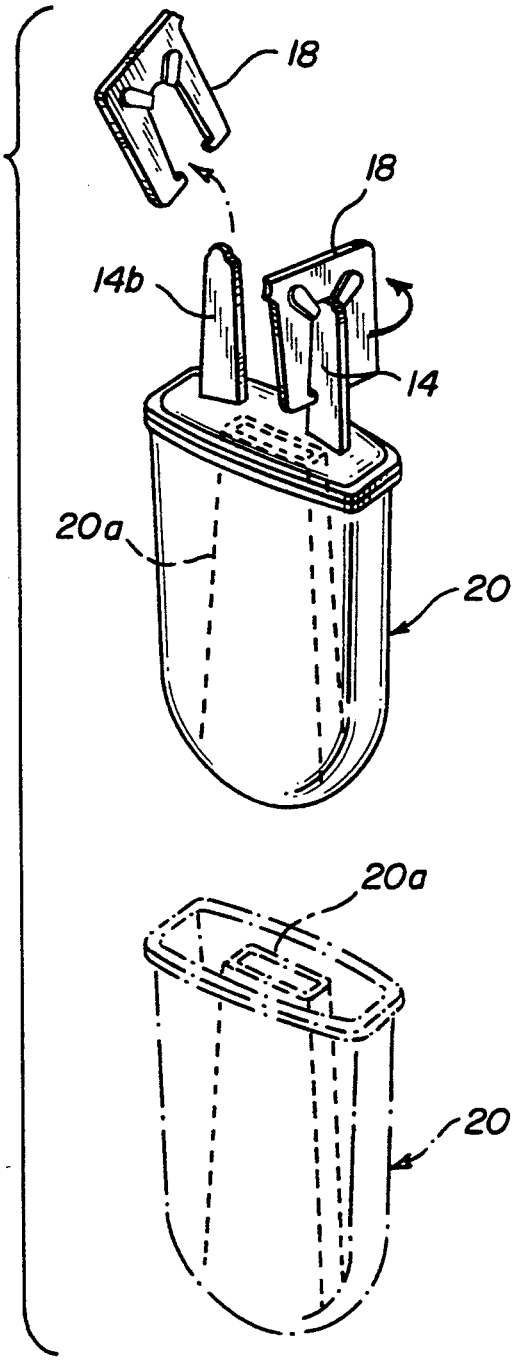
FIG. 4 is a perspective view of an alternative embodiment of the invention, wherein the bottle contains internal cores and also shows the break-off tab being removed for use of the device.
Figure 5:
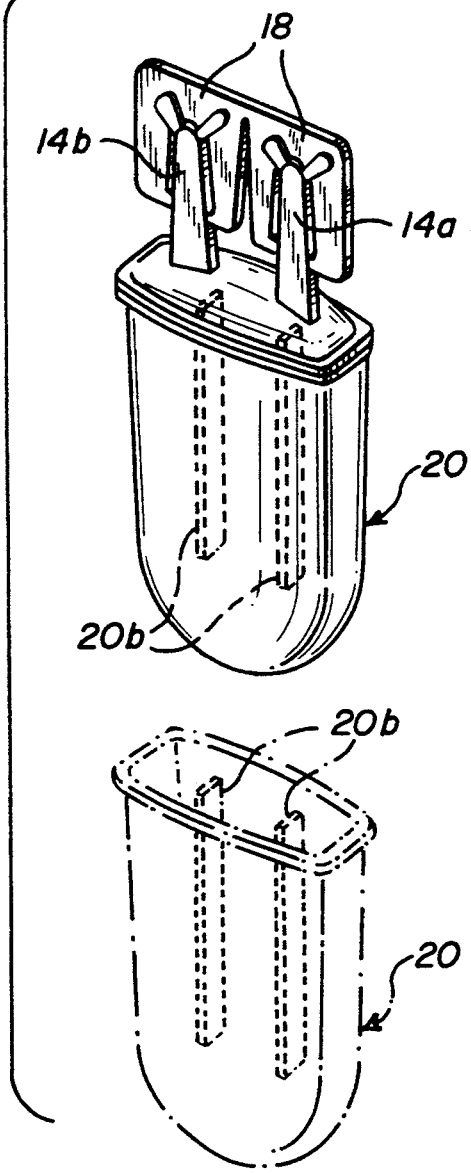
FIG. 5 is a perspective view of an alternative embodiment of the invention, wherein the bottle contains internal ribs.

In another embodiment of the present invention shown in FIGS. 4 and 5 bottle 20 has internal cores 20*a* which are interposed in the bottle or one or more internal ribs 20*b* which are positioned on at least one wall of the bottle to limit the stroke in the bottle when it is squeezed. In still another embodiment of the invention shown in FIGS. 6*a* and 6*b* consists of a bottle which is produced with dimples or indentations 30*a* to limit stroke volume.

The liquid medication can be added to the container in several ways which would be obvious to one skilled in the art. For example, the liquid can be added to the bottle prior to thermally sealing the dispenser lid 12 to bottle 10; it can be added through one of the openings in the nozzle before sealing the openings with the break-off security tab; or it can be added through a fill spout 40 (FIG. 6*a*) in the bottle which is then thermally sealed.

In accordance with the present invention the single use dispensing device provides a means to get beneath the fur of an animal and express the entire liquid contents of the bottle in several small doses. The device is utilized by breaking or twisting off the break-off security tabs, positioning the container with the nozzle openings facing downward toward the animal beneath the fur of the animal's skin and applying from about 15% to 25%, preferrably 20%, of the total liquid medication to the skin of the animal with each pump stroke (full squeeze) of the bottle until the entire contents of the bottle has been dispensed.

After application of the medication, the empty container will be discarded. There is no provision of this delivery device to be recapped, refilled, resealed, or reused after opening, since it is a single use applicator. There is also no stand-up requirement for this dispensing container.

What is claimed is:

1. A container for storing and dispensing liquid antiparasitic medicine beneath the fur of an animal, comprising a dispensing end and a sealed reservoir end containing the liquid contents; said dispensing end having two parallel coplanar nozzles, each about 0.5 to 5 cm long and spaced about 0.5 to 8 cm apart; each nozzle having an opening of about 0.2 to 1.0 mm for dispensing said liquid contents, said opening being sealed by removable sealing means, said reservoir end having inwardly deformable oppositely arranged side walls, said side walls having sufficient structural stiffness such that inward deflection causes fractional expulsion of said total liquid contents.

2. The container of claim 1 wherein the removable sealing means is a break-off tab, which can be manually broken off to open the container for use.

* * * * *